US005467681A

United States Patent [19]

Liberman

[11] Patent Number: 5,467,681

[45] Date of Patent: Nov. 21, 1995

[54] CANNON LAUNCHED RECONNAISSANCE VEHICLE

[75] Inventor: Harold J. Liberman, Randolph, N.J.

[73] Assignee: The United States of America as represented by the Secretary of the Army, Washington, D.C.

[21] Appl. No.: 281,797

[22] Filed: Jul. 21, 1994

[51] Int. Cl.[6] ..... F42B 10/00

[52] U.S. Cl. ..... 89/1.11; 244/3.1

[58] Field of Search ..... 89/1.11; 102/387; 244/3.1

[56] References Cited

U.S. PATENT DOCUMENTS

| | | | |
|---|---|---|---|
| 2,987,269 | 6/1961 | Weller | 244/3.13 |
| 4,004,487 | 1/1977 | Eichweber | 89/1.815 |
| 4,267,562 | 5/1981 | Raimondi | 358/109 |
| 5,056,740 | 10/1981 | Roth et al. | 244/158 R |
| 5,111,748 | 5/1992 | Thurner et al. | 102/387 |

*Primary Examiner*—Charles T. Jordan
*Assistant Examiner*—Theresa M. Wesson
*Attorney, Agent, or Firm*—Anthony T. Lane; Edward Goldberg; Michael C. Sachs

[57] ABSTRACT

The invention offers a novel way to enhance the time of a surveillance payload over a target area. It provides a relatively inexpensive way to position an unmanned reconnaissance payload over a potential target area, using a cargo projectile launched from a conventional tubed artillery piece, under all weather and environmental conditions. The use of tow line between the ejected reconnaissance payload and the ballistic cargo projectile allow the payload with its parafoil to achieve a greater height, enter an orbit and extend a longer time over the target area.

4 Claims, 2 Drawing Sheets

CANNON LAUNCHED RECONNAISSANCE VEHICLE

The invention described herein may be manufactured, used and licensed by or for the Government for Governmental purpose without payment to me of any royalties therein.

BACKGROUND OF THE INVENTION

1. Field of Invention

This invention relates to military intelligence gathering systems for the collection of battlefield intelligence—while minimizing the inherent risks to human spotters, aircrafts, or remotely piloted vehicles (RPV's), and the need of having a specially trained crew and dedicated equipment.

2. Background of Invention

A problem has always existed, because one must know targeting information before shooting a mission. Forward observers and remotely piloted vehicles, either on the ground or in the spotter aircraft, have been used to provide this information. Their methods are unsatisfactory for solving the problem because of the risk posed to human observers and the high cost of remotely piloted systems.

During periods of inclement weather, operation of aircraft or RPV's might not be possible, human spotters on the ground or in the air are subject to dangers, and operation of aircraft and RPV's are costly and require specially trained crews and dedicated equipment. Finally, the aircraft spotters and RPV's may not be under the direct control of the organization in need of information which can result in delay or denial of the information.

This invention provides a relatively inexpensive way to position a payload over a potential target area under all weather and environmental conditions.

SUMMARY OF INVENTION

The invention offers a novel way to enhance the time of a payload over a target area even with the constraints imposed by the conventional ballistic flight of a cargo projectile. It offers a low cost method to gather intelligence without the inherent risk to human spotters, aircrafts, or RPV's. This capability could provide extended payload capability over the area of interest for the smallest organizational element such as the artillery battery level, because each gun could carry one or more cannon launched reconnaissance vehicles. The invention would not require specially trained personnel, and it could be used under environmental conditions that would negate other means of surveillance such as spotter aircraft.

The cannon launched reconnaissance vehicle does not require a special or dedicated launcher, but can be launched from conventional tubed artillery. Specifically, the cannon launched reconnaissance vehicle is not limited to the flight conditions offered by a typical cargo projectile ejecting a parachute with a payload. The cannon launched reconnaissance vehicle differs by using a novel post ejection tow technique from the projectile to gain altitude and hence time over the target; therefore it can remain on station longer than a parachute/payload ejected from a cargo projectile in the conventional manner.

BRIEF DESCRIPTIONS OF DRAWINGS

DETAILED DESCRIPTION OF THE PREFERRED EMBODIMENT

Figure 1:
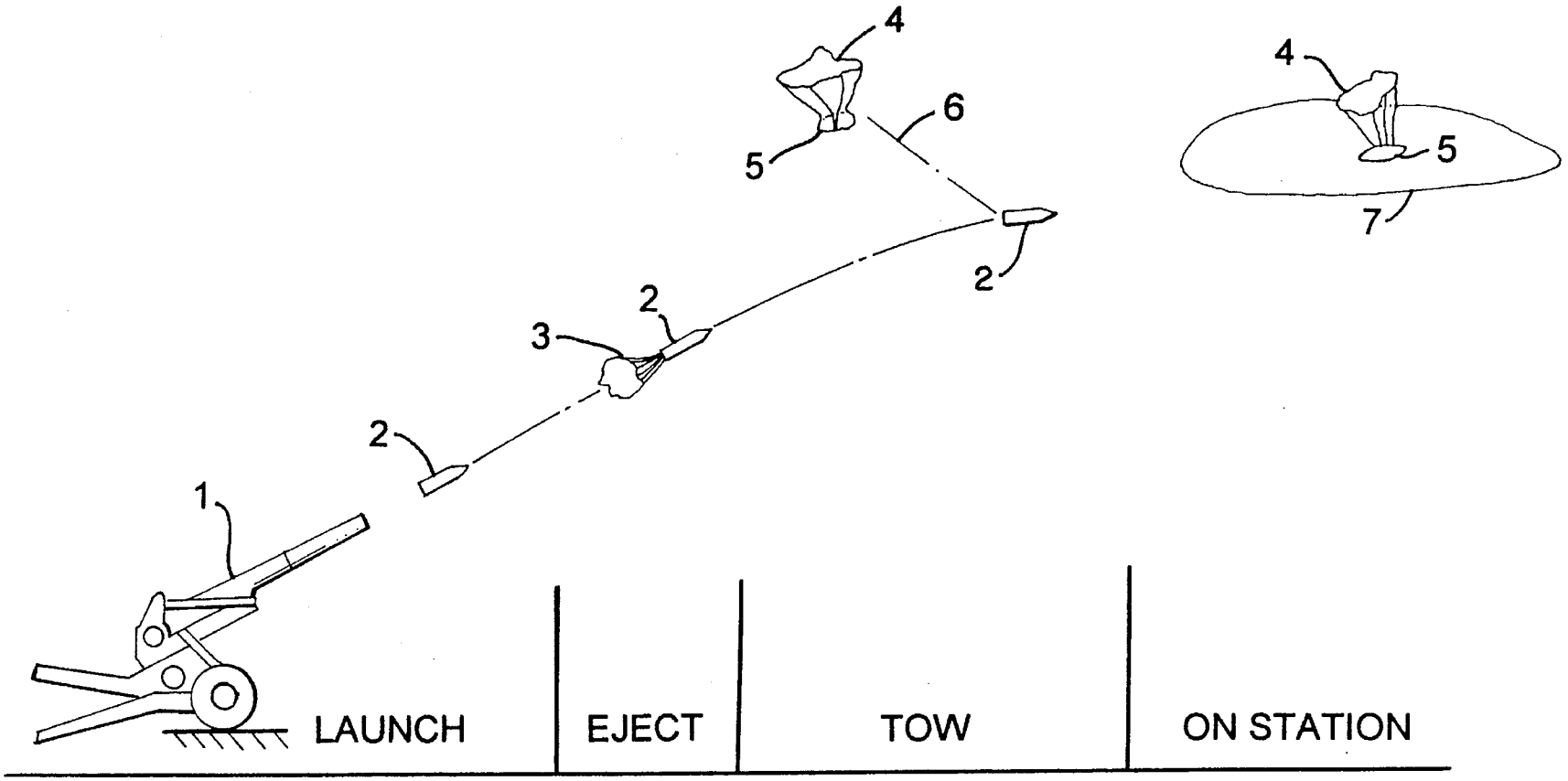
FIG. 1 is an operational description of the cannon launched reconnaissance vehicle (CLRV) depicting: launch; payload ejection; view of the payload as it is towed to an altitude higher than the ejection altitude by the pulling action of the projectile upon the deployed parafoil; and the parafoil into orbit over the area of interest which is called the on station.

FIG. 1 refers to the operational description of the invention. FIG. 1 depicts the launch of a projectile 2 from an artillery piece 1. In particular, the projectile 2, known as the cannon launched reconnaissance vehicle, is loaded into the gun 1 and fired as would be any other conventional projectile. The elevation angle, azimuth, amount of propellant (zone), and fuze 17 setting are made. The fuze 17 setting will determine when the cargo, consisting of the reconnaissance payload 5 and the parafoil 4, are ejected.

FIG. 1 shows the payload 5 being ejected. The preset fuze 17 initiates the ejection of the cargo 4,5. A small drogue chute 3 is expelled first, and it pulls out the parafoil 4 which in turn pulls out the payload 5. The payload 5 carries the reconnaissance equipment. When this cargo 4,5 has exited the projectile 2, it is still not free to float to earth. A fine line 6 is still attached from the projectile 2 to the cargo 4,5.

FIG. 1 depicts the payload 5 as it is towed to an altitude higher than the ejection altitude. The fine line 6 is payed out from the projectile 2 with a small resistance. The projectile 2 continues on its ballistic path. The result is similar to one running with a kite on a string, and the empty cargo projectile 2 is now used to tow the parafoil 4 to a higher altitude as it continues on its ballistic path. The peak altitude is reached when the line runs out, and the cargo 4,5 is now free to glide over the area of interest on station. The tow enables a higher altitude to be attained over that of a conventional ejection, and therefore, a longer time to perform the mission is gained during the on station of operation.

Figure 2:
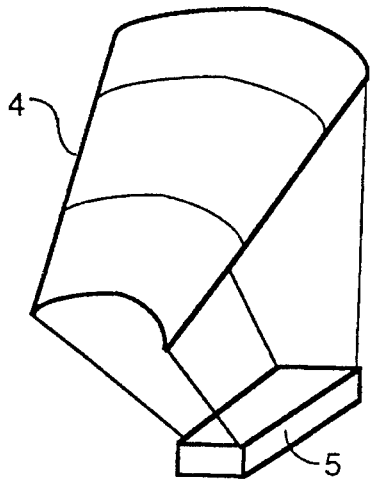
FIG. 2 depicts the parafoil along with the reconnaissance payload orbiting over the target area.

FIG. 1 depicts the area of interest over which the parafoil 4 orbits. The parafoil 4 at FIG. 2 is comprised of two unequal areas or a trapezoidal area, and this causes an inequality in the lift produced by the parafoil 4. The trapezoidal area or as shown at FIG. 2 forces the circular orbit. The result is that the parafoil 4 along with its payload 5 enters a predetermined orbit 7 over the target area.

Figure 3:
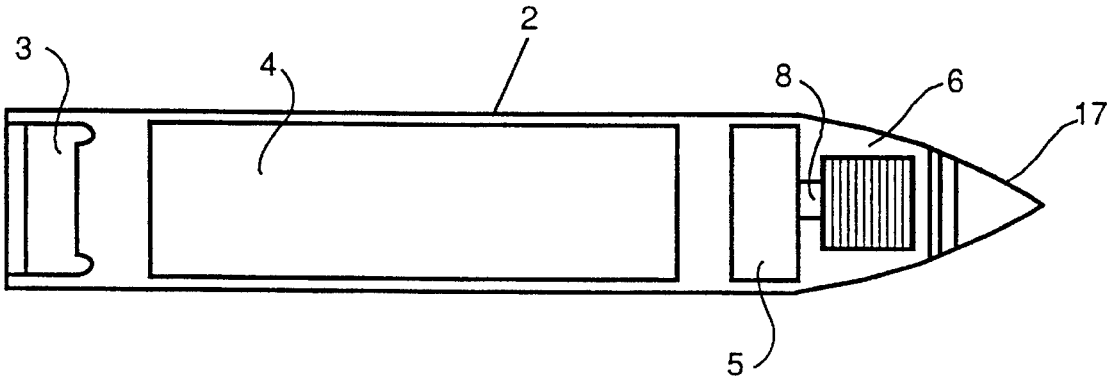
FIG. 3 is a cross sectional view of the cargo projectile and its cargo.

FIG. 3 shows a cross section of the cargo projectile 2 and its cargo 4,5. It is envisioned that the projectile 2 would be a conventional cargo projectile currently existing in the inventory with a time fuze 17 in the nose. The payout line 6 would be wound about the longitudinal axis of the projectile 2 and located ahead of the payload 5 with the line 6 going through a frictional device 8 located between the payload 5 and the line 6. The parafoil 4 is folded behind the payload 5, and it in turn is attached to the drogue parachute 3. The rear of the projectile 2 is blown out through initiation of the fuze 17, and the train of events as shown at FIG. 1 takes place as described above.

Thus, it is apparent that in accordance with the present invention, a functional design that fully meets a serious military reconnaissance and target collection need is set forth. While the invention has been described in conjunction with a specific embodiment, it is evident that many alternations, modifications and variations will be apparent to those skilled in light of the foregoing descriptions. Exchanging the surveillance payload for a "smart" munition would be but one such example. Accordingly, it is intended that the present invention embrace all such alterations, modifications, and variations that fall within the spirit and broad scope of the appended claims.

What is claimed is:

1. An unmanned reconnaissance device which can be launched from conventional cannon artillery, and which device has an extended altitude feature, making available an extended time for reconnaissance of an area which is under surveillance, said device comprising:

a projectile having a surveillance cargo which comprises a reconnaissance payload suspended from a parafoil in which said parafoil includes a drogue chute, said chute being connected to said projectile by a line means, said projectile having means to eject said surveillance cargo from said projectile, said means to eject being initiated during flight by a preset fuze which initiates said ejection when said projectile is essentially at the highest point of its trajectory by releasing said drogue chute, and said drogue chute thereafter acting to pull out said parafoil which has attached thereto said reconnaissance payload, said parafoil also being attached to said line means to maintain its connection to said projectile, whereby said extended altitude feature is achieved inasmuch as said reconnaissance payload after ejection can reach an altitude higher than that of said projectile altitude, while still attached to said line means, through a kite-like action of the parafoil rising higher than said projectile, and said reconnaissance payload being suspended from said parafoil thereby also rising higher than said projectile.

2. The device as in claim 1 whereby said line means is paid out from said projectile with a small resistance, until the end of said line means is reached, and said parafoil with reconnaissance payload is released from attachment to the projectile when the end of said line means is reached.

3. The device as in claim 2 wherein the structure of the parafoil is comprised of two unequal areas each shaped in the form of a trapezoid, the parafoil structure making possible a circular spiral shaped descending orbit as the reconnaissance payload with parafoil descend over the surveillance area after they are released at the finish of said line means being paid out.

4. The device as in claim 1 wherein release of said drogue chute is accomplished by blowing out the rear end of the projectile, to release said chute.

* * * * *